US011008955B2

(12) United States Patent
Okamoto

(10) Patent No.: US 11,008,955 B2
(45) Date of Patent: May 18, 2021

(54) CONTROL DEVICE FOR INTERNAL COMBUSTION ENGINE AND CONTROL METHOD FOR VARIABLE MECHANISM FOR INTERNAL COMBUSTION ENGINE

(71) Applicant: Hitachi Automotive Systems, Ltd., Hitachinaka (JP)

(72) Inventor: Naoki Okamoto, Isesaki (JP)

(73) Assignee: Hitachi Automotive Systems, Ltd.

( * ) Notice: Subject to any disclaimer, the term of this patent is extended or adjusted under 35 U.S.C. 154(b) by 32 days.

(21) Appl. No.: 16/334,163

(22) PCT Filed: Mar. 6, 2018

(86) PCT No.: PCT/JP2018/008507
§ 371 (c)(1),
(2) Date: Mar. 18, 2019

(87) PCT Pub. No.: WO2018/164097
PCT Pub. Date: Sep. 13, 2018

(65) Prior Publication Data

US 2019/0376456 A1 Dec. 12, 2019

(30) Foreign Application Priority Data

Mar. 9, 2017 (JP) ..... JP2017-044759

(51) Int. Cl.
*F02D 15/02* (2006.01)
*F02B 75/04* (2006.01)

(52) U.S. Cl.
CPC ..... *F02D 15/02* (2013.01); *F02B 75/048* (2013.01)

(58) Field of Classification Search
CPC ..... F02D 15/02; F02D 45/00; F02B 75/048
See application file for complete search history.

(56) References Cited

U.S. PATENT DOCUMENTS

2007/0192001 A1 8/2007 Tatsumi et al.
2009/0048764 A1 2/2009 Fuwa
(Continued)

FOREIGN PATENT DOCUMENTS

JP 2006-161583 A 6/2006
JP 2007-23898 A 2/2007
(Continued)

OTHER PUBLICATIONS

International Search Report (PCT/ISA/210) issued in PCT Application No. PCT/JP2018/008507 dated May 29, 2018 with English translation (four (4) pages).
(Continued)

*Primary Examiner* — Jacob M Amick
*Assistant Examiner* — Charles Brauch
(74) *Attorney, Agent, or Firm* — Crowell & Moring LLP

(57) ABSTRACT

A control device for an internal combustion engine and a control method for a variable mechanism for an internal combustion engine for a vehicle, according to the present invention, is configured to maintain a drive stopped state of an electric actuator of the variable mechanism when a position of the electric actuator does not change in a case in which the position of the electric actuator is apart from stoppers and the electric actuator is stopped, whereas to restart driving the electric actuator when the position of the electric actuator changes. In this way, it is possible to prevent wasteful power consumption while the internal combustion engine is stopped.

9 Claims, 8 Drawing Sheets

(56) References Cited

U.S. PATENT DOCUMENTS

| | | | | |
|---|---|---|---|---|
| 2014/0041607 | A1* | 2/2014 | Hiyoshi | F02D 15/02 123/90.15 |
| 2014/0288724 | A1* | 9/2014 | Noguchi | G05B 15/02 700/297 |
| 2017/0074179 | A1 | 3/2017 | Mikawa | |

FOREIGN PATENT DOCUMENTS

| | | | | | |
|---|---|---|---|---|---|
| JP | 2007023898 | A | * | 2/2007 | F01L 13/00 |
| JP | 2007-191098 | A | | 8/2007 | |
| JP | 2009-174473 | A | | 8/2009 | |
| JP | 2012-36864 | A | | 2/2012 | |
| JP | 2015-166587 | A | | 9/2015 | |
| JP | 2015166587 | A | * | 9/2015 | F02D 13/0238 |
| JP | 2016-117452 | A | | 6/2016 | |
| WO | WO 2017/009962 | A1 | | 1/2017 | |

OTHER PUBLICATIONS

Japanese-language Written Opinion (PCT/ISA/237) issued in PCT Application No. PCT/JP2018/008507 dated May 29, 2018 (six (6) pages).

International Preliminary Report on Patentability (PCT/IB/338 & PCT/IB/373) issued in PCT Application No. PCT/JP2018/008507 dated Sep. 19, 2019, including English translation of document C2 (Japanese-language Written Opinion (PCT/ISA/237 previously filed on Mar. 18, 2019)) (13 pages).

Japanese-language Office Action issued in counterpart Japanese Application No. 2017-044759 dated Nov. 5, 2019 with partial English translation (13 pages).

* cited by examiner

CONTROL DEVICE FOR INTERNAL COMBUSTION ENGINE AND CONTROL METHOD FOR VARIABLE MECHANISM FOR INTERNAL COMBUSTION ENGINE

TECHNICAL FIELD

The present invention relates to control devices for internal combustion engines and to control methods for variable mechanisms for internal combustion engines, and more specifically, relates to control techniques for internal combustion engines provided with variable mechanisms that make the operating characteristics of internal combustion engines variable by electric actuators.

BACKGROUND ART

Patent Document 1 discloses a variable compression ratio mechanism that continuously changes the mechanical compression ratio of an internal combustion engine by changing the top dead center position of a piston of the internal combustion engine.

This variable compression ratio mechanism is a mechanism that changes the top dead center position of a piston of the internal combustion engine by driving a control shaft to rotate by an electric actuator including an electric motor.

REFERENCE DOCUMENT LIST

Patent Document

Patent Document 1: JP 2016-117452 A

SUMMARY OF THE INVENTION

Problem to be Solved by the Invention

For example, in a variable compression ratio mechanism that changes the top dead center position of a piston of an internal combustion engine by an electric actuator, combustion pressure acts as an assisting force that assists the operation of the variable compression ratio mechanism when decreasing the compression ratio, whereas combustion pressure acts as a reaction force that prevents the operation of the variable compression ratio mechanism when increasing the compression ratio.

Thus, it is necessary for a control device for controlling the variable compression ratio mechanism to have the electric actuator generate a torque resisting against the reaction force even in a case of maintaining a compression ratio which has reached a target value.

Furthermore, in a case in which the control device includes a self-shutdown circuit that performs self-shutoff of the power supply based on a switching signal indicating a manipulated state of a power switch of the internal combustion engine, when an abnormality that the switching signal input in the circuit is fixed to a level indicating that the power switch is in a turned-on state occurs by short circuiting a signal line, or the like, the control device might be maintained in a power-on state even when the power switch is manipulated to be OFF.

Furthermore, in a case of a system in which the control device is connected to an in-car communication line, such as a CAN (controller area network), and controls a variable mechanism, receiving a target value for the variable mechanism from an external device through this in-car communication line, there may be a case in which the variable mechanism is configured to be controlled to a target value for failure (hereinafter, referred to as "failure target value") stored in advance in an internal memory at the time of communication abnormality.

In such a configuration, when the power switch is manipulated to be OFF in a state in which the control device maintains a power-on state due to an ON-fixing failure of the switching signal, and the power supply of the external device that transmits the target value is shut off, then communications with the external device becomes abnormal, and the control device thus controls the variable mechanism with the failure target value.

At this time, the control device, similarly to a case of normal communication, controls the electric actuator so that the electric actuator continues to generate a holding torque even after the controlled variable converges on the target value. Thus, energization of the electric actuator is continued while the internal combustion engine is in a stopped state, and a large quantity of electric power might be wastefully used up by the electric actuator.

Thus, since the control device cannot detect the occurrence of the ON-fixing failure of the switching signal, and cannot determine whether the communication abnormality occurs due to the turning off of the power switch or due to a failure of the in-car communication line (in other words, whether the internal combustion engine is in operation or in a stopped state), there is a case in which, even while the internal combustion engine is stopped, the control device continues to control the drive control of the electric actuator for generating a torque resisting a reaction force of the internal combustion engine, in the same manner as in operation.

Furthermore, if the electric actuator continues to be driven even while the internal combustion engine is stopped, there might also have been a problem in that a battery is used up due to the power consumption by the electric actuator, resulting in a decrease in startup performance of the internal combustion engine.

The present invention has been made in view of these problems, and an object is to provide a control device for an internal combustion engine and a control method for a variable mechanism for the internal combustion engine, capable of performing a control operation depending on whether the internal combustion engine is in operation or in a stopped state.

Means for Solving the Problem

In the present invention, according to an aspect thereof, when a position of the electric actuator does not change from a position apart from stoppers in a state in which the driving of the electric actuator is stopped, the driving of the electric actuator is maintained in the stopped state, whereas when the position of the electric actuator changes from the position apart from the stoppers in a state in which the driving of the electric actuator is stopped, the driving of the electric actuator is restarted.

Effects of the Invention

According to the foregoing invention, the control device is capable of performing a control operation depending on whether the internal combustion engine is in operation or in a stopped state, so that it is possible to prevent the control operation that might wastefully use up the electric power from being performed while the internal combustion engine is stopped.

MODE FOR CARRYING OUT THE INVENTION

Hereinbelow, an embodiment of the present invention will be described.

Figure 1:
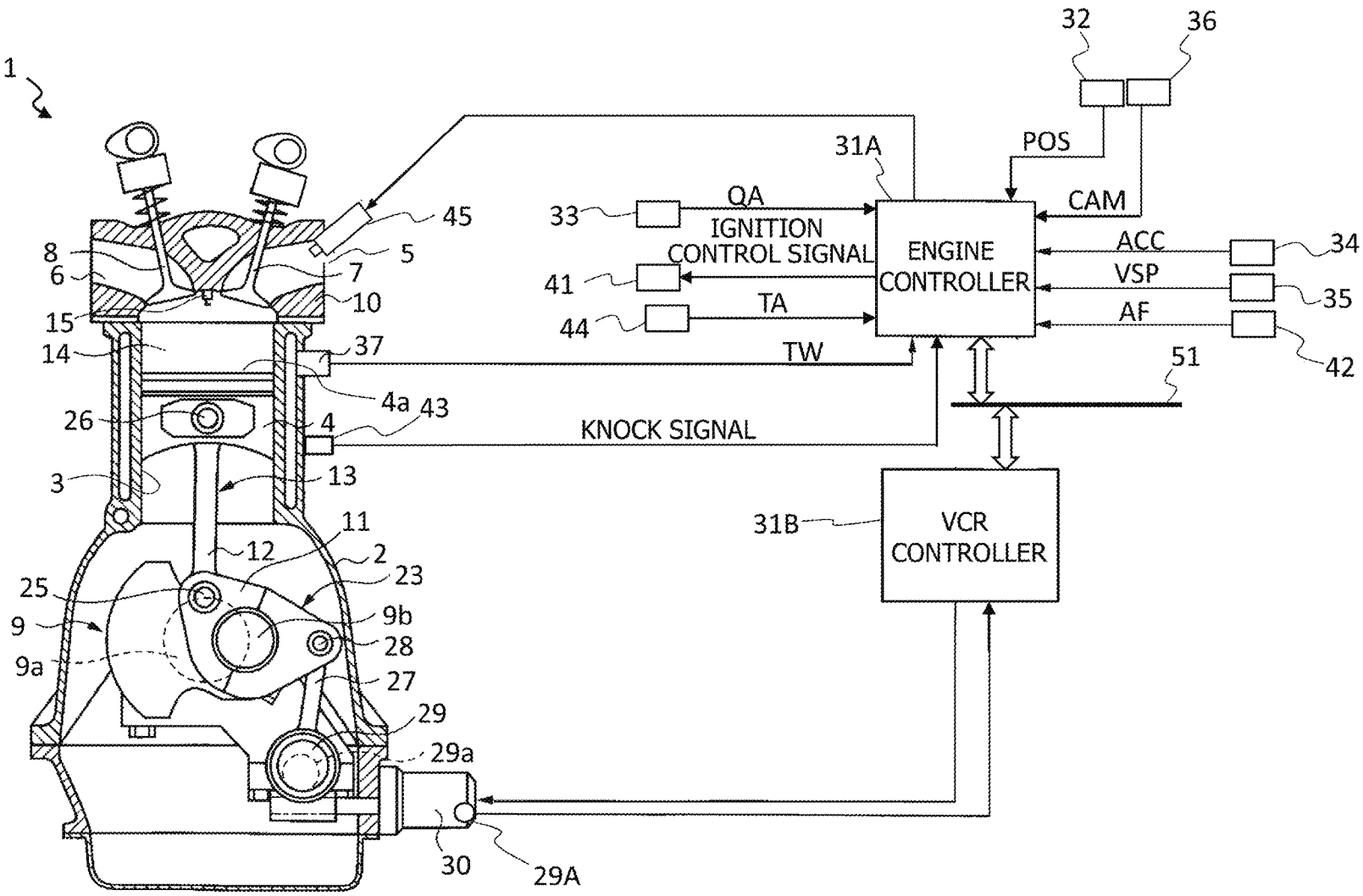
FIG. 1 is a system configuration diagram of an internal combustion engine for a vehicle according to an embodiment of the present invention.

FIG. 1 illustrates an aspect of an internal combustion engine for a vehicle.

An internal combustion engine 1 for a vehicle illustrated in FIG. 1 includes a cylinder block 2, a piston 4 provided inside a cylinder bore 3 formed in cylinder block 2, a cylinder head 10 in which intake ports 5 and exhaust ports 6 are formed, and for each cylinder, a pair of intake valves 7, 7 that opens and closes opening ends of intake ports 5 and a pair of exhaust valves 8, 8 that opens and closes opening ends of exhaust ports 6.

Piston 4 is connected to a crankshaft 9 by a connecting rod 13 that includes a lower link 11 and an upper link 12.

Furthermore, a combustion chamber 14 is formed between a crown 4*a* of each piston 4 and the lower surface of the corresponding cylinder head 10. An ignition plug 15 is provided substantially at the center of each cylinder head 10 that defines combustion chamber 14.

Ignition plug 15 ignites and combusts a fuel in combustion chamber 14 by spark discharge through the supply of high voltage from an ignition coil 41.

Furthermore, internal combustion engine 1 includes a variable compression ratio mechanism 23 that makes the mechanical compression ratio variable by changing the top dead center position of piston 4. Variable compression ratio mechanism 23 is an example of a variable mechanism that makes the operating characteristics of internal combustion engine 1 variable by an electric actuator.

Hereinbelow, an example of the structure of variable compression ratio mechanism 23 will be described.

Crankshaft 9 includes at least two journal portions 9*a* and at least two crank pin portions 9*b*, and journal portions 9*a* are rotatably supported by main bearings of cylinder block 2.

Crank pin portion 9*b* is eccentric from journal portion 9*a*, and lower link 11 is rotatably connected to crank pin portion 9*b*.

Lower link 11 is formed to be divided into two pieces, and crank pin portion 9*b* is fitted to a connecting hole provided substantially at the center of lower link 11.

The lower end side of upper link 12 is connected to one end of lower link 11 by a connecting pin 25 in a rotationally movable manner, and the upper end side of upper link 12 is connected to piston 4 by a piston pin 26 in a rotationally movable manner.

The upper end side of a control link 27 is connected to the other end of lower link 11 by a connecting pin 28 in a rotationally movable manner, and the lower end side of control link 27 is connected to a lower portion of cylinder block 2 via a control shaft 29 in a rotationally movable manner.

Specifically, control shaft 29 is rotatably supported by cylinder block 2, which is an internal combustion engine body, and control shaft 29 has an eccentric cam portion 29*a* that is eccentric from the center of rotation of control shaft 29. The lower end portion of control link 27 is rotatably fitted to eccentric cam portion 29*a*.

Control shaft 29 is rotated by an electric actuator 30 using an electric motor as a power source.

In such a variable compression ratio mechanism 23 using the abovementioned multi-link piston-crank mechanism, the central position of eccentric cam portion 29*a*, that is, the position of eccentric cam portion 29*a* relative to cylinder block 2 of internal combustion engine 1 is changed when control shaft 29 is rotated by electric actuator 30.

This changes the oscillation-support position of the lower end of control link 27 and accordingly changes the stroke of piston 4 so that the position of piston 4 at the piston top dead center (TDC) is raised or lowered, resulting in change in mechanical compression ratio of internal combustion engine 1.

That is, the position of piston 4 at the top dead center is one of the operating characteristics of internal combustion engine 1, and variable compression ratio mechanism 23 is an aspect of the variable mechanism that makes the operating characteristics of the internal combustion engine for a vehicle variable by the electric actuator.

Furthermore, in variable compression ratio mechanism 23, combustion pressure acts as an assisting force that assists the operation of the variable compression ratio mechanism when decreasing the compression ratio, whereas combustion pressure acts as a reaction force that prevents the operation of the variable compression ratio mechanism when increasing the compression ratio.

Thus, in drive control of variable compression ratio mechanism 23, it is necessary to have electric actuator 30 generate a torque resisting against the reaction force even in a case of maintaining a compression ratio which has reached a target value.

Ignition coils 41, fuel injection valves 45 that inject fuel into intake ports 5, and the like, are controlled by an engine controller 31A, and variable compression ratio mechanism 23 is controlled by a VCR controller 31B.

Each of engine controller 31A and VCR controller 31B includes a microcomputer that includes a processer (CPU) and a memory. Engine controller 31A and VCR controller 31B are connected to a CAN (controller area network) 51, which constitutes an in-car communication line, and engine controller 31A and VCR controller 31B are configured to be interactively communicable with each other.

Engine controller 31A calculates a target value for variable compression ratio mechanism 23 based on operating conditions, such as a load and a rotational speed of internal combustion engine 1, and transmits the data of the calculated target value to VCR controller 31B.

VCR controller 31B reads the data of target value transmitted from the engine controller 31A, which is an external device, and reads an output signal of an angle sensor 29A that senses the angular position of control shaft 29.

Then, VCR controller 31B performs a feedback control of compression ratio that calculates a manipulated variable of electric actuator 30 such that the angular position of control shaft 29 obtained based on the output signal of angle sensor 29A approaches the target value, and outputs the calculated manipulated variable, to electric actuator 30.

VCR controller 31B is capable of obtaining an actual compression ratio from the angular position of control shaft 29 obtained based on the output signal of angle sensor 29A, and is capable of calculating the manipulated variable by comparing this actual compression ratio and a target compression ratio. Furthermore, VCR controller 31B is capable of calculating the manipulated variable by comparing the angular position of control shaft 29 obtained based on the output signal of angle sensor 29A and a target angular position obtained from the target compression ratio.

On the other hand, VCR controller 31B outputs, to engine controller 31A, information about the angular position of control shaft 29 obtained based on the output of angle sensor 29A or information about compression ratio obtained from the sensed value of the angular position, and information about diagnosis results, and the like.

Both engine controller 31A and VCR controller 31B may be configured to receive the output signal of angle sensor 29A.

Furthermore, engine controller 31A receives output signals of various sensors that sense an operation state of internal combustion engine 1.

As the various sensors, internal combustion engine 1 is provided with a crank angle sensor 32 that outputs angle signal POS at a predetermined angular position of crankshaft 9, an air flow sensor 33 that senses intake air flow rate QA of internal combustion engine 1, an accelerator opening sensor 34 that senses accelerator opening ACC correlating with a depression amount of the accelerator pedal depressed by a driver of the vehicle, a vehicle speed sensor 35 that senses running speed VSP of the vehicle in which internal combustion engine 1 is mounted, a cam angle sensor 36 that outputs angle signal CAM at a predetermined angular position of an intake camshaft 24, a water temperature sensor 37 that senses temperature TW of coolant of internal combustion engine 1, an air-fuel ratio sensor 42 that senses air-fuel ratio AF based on the concentration of oxygen contained in exhaust gas of internal combustion engine 1, a knocking sensor 43 that detects vibrations caused by knocking of internal combustion engine 1, an intake air temperature sensor 44 that senses intake air temperature TA of internal combustion engine 1, and the like.

Engine controller 31A controls the operation of internal combustion engine 1 by calculating the amount of fuel to be supplied to internal combustion engine 1, the ignition timing of ignition plug 15, and the like, based on the signals obtained from the various sensors, by outputting an injection pulse signal to fuel injection valves 45, and by outputting an energization control pulse signal of ignition coil 41.

Figure 2:
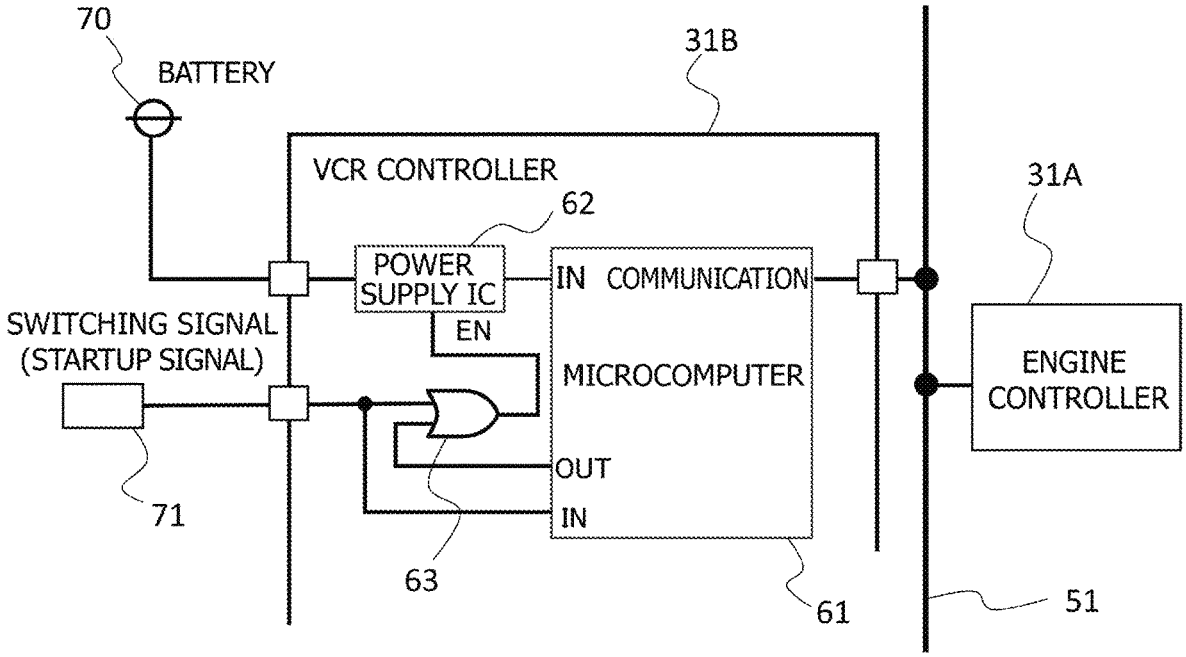
FIG. 2 is a block diagram illustrating the internal configuration of a VCR controller according to the embodiment of the present invention.

FIG. 2 is a diagram for describing the internal configuration of VCR controller 31B.

VCR controller 31B includes a microcomputer 61 including a processor and a memory, a power supply IC 62 that receives power supplied from an external battery 70 and supplies power to microcomputer 61, a power supply control circuit (power supply unit) 63 having a self-shutdown function, and the like.

Microcomputer 61 is connected to CAN 51, which is an in-car communication line, and obtains, through CAN 51, data of a target value from engine controller 31A, which is also connected to CAN 51.

Power supply control circuit 63 receives a switching signal indicating a manipulated state of a power switch 71 of internal combustion engine 1, and a power supply control signal, which is an output signal of microcomputer 61. The output of power supply control circuit 63 is input to power supply IC 62 as enable signal EN.

Furthermore, the switching signal indicating the manipulated state of power switch 71 is also input to microcomputer 61, and microcomputer 61 is configured to be able to detect the turning on and the turning off of power switch 71.

Furthermore, power supply control circuit 63 makes enable signal EN active when microcomputer 61 receives the switching signal indicating that power switch 71 is manipulated to be ON, to have power supply IC 62 apply power to microcomputer 61.

Furthermore, power supply control circuit 63 also makes enable signal EN active when microcomputer 61 outputs a power-on request signal to power supply control circuit 63, to have power supply IC 62 apply power to microcomputer 61.

That is, power supply control circuit 63 makes enable signal EN active in a state in which the switching signal indicating power switch 71 is manipulated to be ON is input, and/or in a state in which microcomputer 61 outputs the power-on request signal, to have power supply IC 62 apply power to microcomputer 61.

Here, when power switch 71 is manipulated to be ON, power is applied to microcomputer 61 to start up microcomputer 61, and then when the switching signal indicating that power switch 71 is manipulated to be ON is input to microcomputer 61, microcomputer 61 starts outputting the power-on request signal. After receiving the switching signal indicating that power switch 71 is manipulated to be OFF, microcomputer 61 performs predetermined processing, and thereafter, stops outputting the power-on request signal (in other words, microcomputer 61 outputs a power shutoff request signal).

If microcomputer 61 stops outputting the power-on request signal in a state in which power switch 71 is manipulated to be OFF, power supply control circuit 63 makes enable signal EN inactive, so as to cut off power supply from power supply IC 62 to microcomputer 61. That is, microcomputer 61 performs self-shutoff of the power supply with a delay from a time point at which power switch 71 is manipulated to be OFF.

Similar to VCR controller 31B, engine controller 31A may also have a self-shutoff function of power supply performed after power switch 71 is manipulated to be OFF.

In VCR controller 31B having the abovementioned configuration, when there is an abnormality that the switching signal input to power supply control circuit 63 is fixed to a level indicating that power switch 71 is manipulated to be ON, caused by short circuiting a signal line, or the like, that is, there is an abnormality that the level of the switching signal is maintained to indicate that power switch 71 is manipulated to be ON despite power switch 71 being manipulated to be OFF, power supply control circuit 63 maintains enable signal EN to be active, so that power supply IC 62 continues applying power to microcomputer 61.

On the other hand, it is configured so that when there is an abnormality in communications with engine controller 31A through CAN 51, and VCR controller 31B fails to obtain the data of target value from engine controller 31A, VCR controller 31B performs fail-safe processing for controlling variable compression ratio mechanism 23 with a failure target value stored in advance in an internal memory.

Here, when power switch 71 is manipulated to be OFF and the power supply to engine controller 31A is shut off thereby in a state in which there is an abnormality that the switching signal input to power supply control circuit 63 is fixed to a level indicating that power switch 71 is manipulated to be ON, then VCR controller 31B determines that there is a communication abnormality and performs the fail-safe processing for controlling variable compression ratio mechanism 23 with the failure target value.

However, although the failure target value is used as a target value, the fail-safe processing is a normal drive control on the premise that the reaction force of internal combustion engine 1 acts, and thus, if internal combustion engine 1 is stopped, electric power might be wastefully used up in electric actuator 30. There is a possibility that this power consumption while internal combustion engine 1 is stopped, may use up battery 70, and startup performance of internal combustion engine 1, which includes battery 70 as a power source, may be reduced.

Thus, microcomputer 61 of VCR controller 31B determines whether internal combustion engine 1 is in operation or is in a stopped state in the fail-safe processing performed at the time of communication abnormality, and when internal combustion engine 1 is in a stopped state, microcomputer 61 performs processing for stopping energization (drive control of electric actuator 30) to electric actuator 30 of variable compression ratio mechanism 23.

FIRST EXAMPLE

Figure 3:
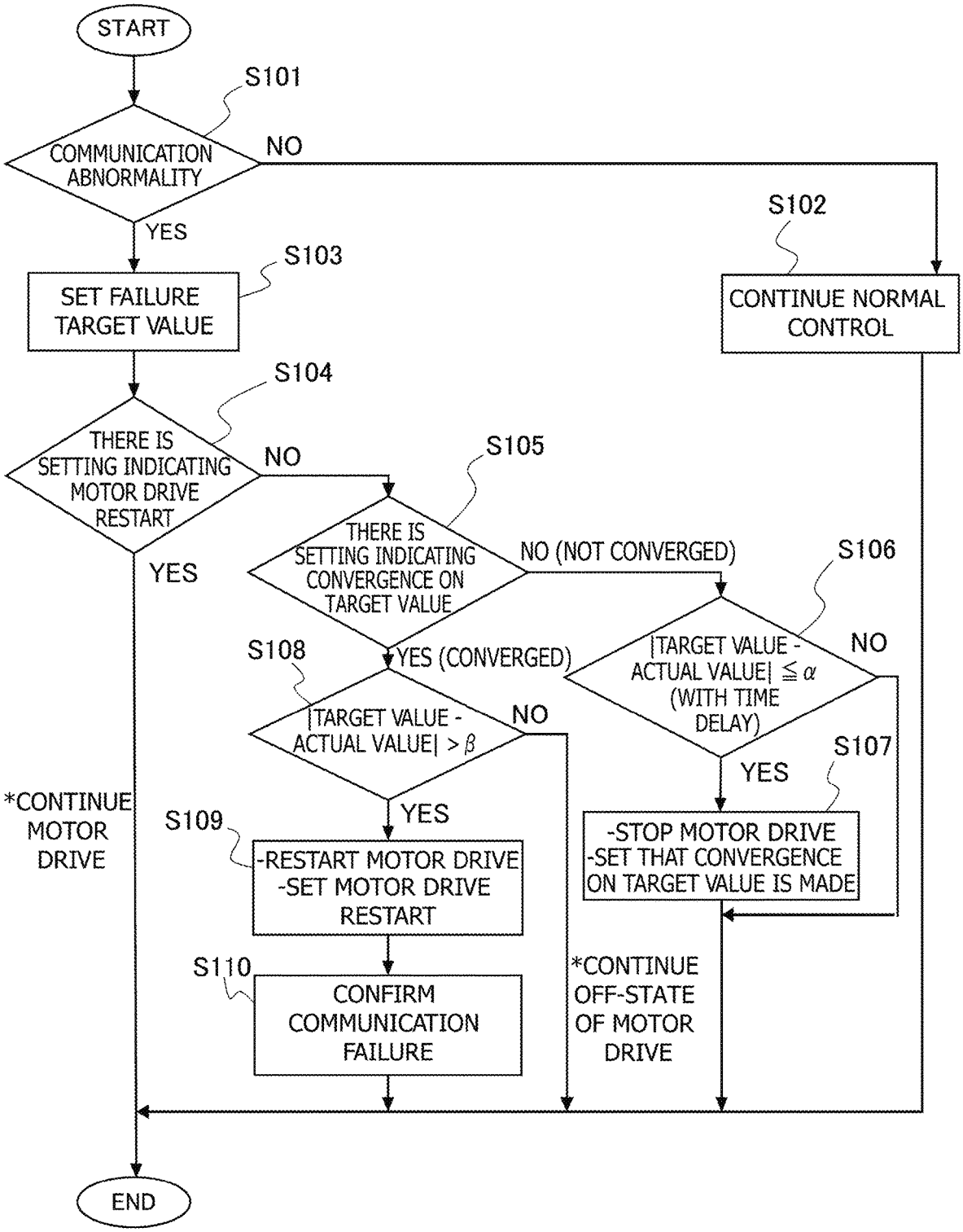
FIG. 3 is a flowchart illustrating a first example of fail-safe processing at the time of communication abnormality according to the embodiment of the present invention.

A flowchart of FIG. 3 illustrates an aspect of the fail-safe processing (control unit) at the time of communication abnormality performed by microcomputer 61 of VCR controller 31B.

In step S101, microcomputer 61 determines whether an abnormality has occurred in communications with engine controller 31A through CAN 51.

Then, when there is no communication abnormality, microcomputer 61 proceeds to step S102, in which microcomputer 61 performs a normal control, that is, a control for normal communications, in which microcomputer 61 calculates a manipulated variable of electric actuator 30 based on a target value transmitted from engine controller 31A and a determination result obtained by angle sensor 29A, and outputs the calculated manipulated variable to electric actuator 30, to make an actual compression ratio approach the target value.

In the control of electric actuator 30 in step S102, microcomputer 61 controls energization to electric actuator 30 so as to generate a torque resisting against the reaction force of internal combustion engine 1 even after the actual compression ratio reaches the target value.

On the other hand, when a communication abnormality has occurred and data of a target value cannot be obtained from engine controller 31A, microcomputer 61 proceeds to step S103, in which microcomputer 61 sets a failure target value, which is stored in advance in the internal memory, as a target value for variable compression ratio mechanism 23.

The variable range of compression ratio in variable compression ratio mechanism 23 is restricted by stoppers, and the failure target value is an intermediate value between a maximum compression ratio and a minimum compression ratio defined by the stopper positions, that is, the failure target value is a compression ratio deviated from both maximum and minimum compression ratios.

Then, microcomputer 61 proceeds to step S104, in which microcomputer 61 determines whether electric actuator 30 is in a drive-restart state for controlling the compression ratio to be the failure target value after a temporary stop of the driving of electric actuator 30.

Here, when electric actuator 30 is not in the drive-restart state, microcomputer 61 proceeds to step S105.

In Step S105, microcomputer 61 determines whether there is a history indicating that the actual compression ratio converged on the failure target value by the drive control of electric actuator 30.

Then, when there is no history indicating the convergence on the failure target value, microcomputer 61 proceeds to step S106, in which microcomputer 61 determines whether an absolute value of a control error that is a difference between the failure target value and the actual compression ratio, that is, an absolute value of a difference between a failure target angle and an actual angle sensed by angle sensor 29A, is less than or equal to set value $\alpha$, to determine whether the actual compression ratio is in a state of converging on the failure target value.

Here, microcomputer 61 can determine that the actual compression ratio is in the convergence state on the failure target value, when a state in which the absolute value of the control error that is a difference between the failure target value and the actual compression ratio, continues for at least a set time period.

When the actual compression ratio is not in the convergence state on the failure target value, microcomputer 61 bypasses step S107 and terminates the routine, so as to drive electric actuator 30 to control the actual compression ratio to be the failure target value.

On the other hand, when the actual compression ratio has converged on the failure target value, microcomputer 61 proceeds to step S107, in which microcomputer 61 cuts off power supply to electric actuator 30 to stop driving electric actuator 30 and saves the history indicating that the actual compression ratio converged on the failure target value.

Once the history indicating that the actual compression ratio converged on the failure target value is saved, microcomputer 61 determines, the next time microcomputer 61 proceeds to step S105, that there is the history indicating that the actual compression ratio converged on the failure target value, and microcomputer 61 proceeds to step S108.

In step S108, microcomputer 61 determines whether the absolute value of the difference between the failure target value and the actual compression ratio becomes greater than set value $\beta$ ($\beta>\alpha$). That is, when the actual compression ratio converges on the failure target value, microcomputer 61 stops driving electric actuator 30, so as to stop generating a holding torque for maintaining the actual compression ratio to be the failure target value, and then monitors whether the actual compression ratio deviates from the failure target value.

Then, when the absolute value of the difference between the failure target value and the actual compression ratio is less than or equal to set value $\beta$ and when the actual compression ratio is maintained to be near the failure target value, microcomputer 61 bypasses steps S109 and S110 and terminates the routine, so as to make the drive stopped state of electric actuator 30 continue. That is, even if the driving of electric actuator 30 is stopped, microcomputer 61 makes electric actuator 30 continue the drive stopped state when the actual compression ratio is maintained to be near the failure target value.

On the other hand, when the absolute value of the difference between the failure target value and the actual compression ratio becomes greater than set value (3, microcomputer 61 proceeds to step S109, in which microcomputer 61 restarts driving electric actuator 30 to control the actual compression ratio to be the failure target value, and saves information indicating that electric actuator 30 is in the drive-restart state.

Furthermore, microcomputer 61 proceeds to step S110, in which microcomputer 61 confirms the determination of the occurrence of communication abnormality.

When restarting driving electric actuator 30 because the actual compression ratio deviates from the failure target value, microcomputer 61 determines, the next time microcomputer 61 proceeds to step S104, that electric actuator 30 is in the drive-restart state, and terminates the routine so as to continue the drive control of electric actuator 30 for controlling the actual compression ratio to be the failure target value.

For example, in a case in which an abnormality occurs in communications with engine controller 31A through CAN 51 and the target value of the compression ratio is set to the failure target value, while the switching signal input to power supply control circuit 63 in a turned-on state of power switch 71 is normal, variable compression ratio mechanism 23 receives the reaction force from internal combustion engine 1 when the driving of electric actuator 30 is stopped, since internal combustion engine 1 is in operation. This results in deviation of the actual compression ratio from the failure target value.

Thus, in a case in which the actual compression ratio deviates from the failure target value by stopping driving of electric actuator 30, microcomputer 61 can presume that internal combustion engine 1 is in operation. When internal combustion engine 1 is in operation, microcomputer 61 makes the drive control of electric actuator 30 continue, to control the actual compression ratio to be the failure target value, so as to prevent a decrease in operability of internal combustion engine 1 at the time of communication abnormality.

On the other hand, when there is an abnormality that the switching signal input to power supply control circuit 63 is fixed to a level indicating that power switch 71 is in a turned-on state, the power supply to engine controller 31A is shut off based on the turning off of power switch 71, resulting in a communication abnormal state in which communications with engine controller 31A cannot be performed. Thus, VCR controller 31B transfers to a fail-safe processing in which the failure target value is used as a target value of compression ratio.

In this case, since internal combustion engine 1 is in a stopped state and no reaction force acts on variable compression ratio mechanism 23, the actual compression ratio does not change even when the driving of electric actuator 30 is stopped after the actual compression ratio converges on the failure target value, so that the actual compression ratio is maintained to be near the failure target value.

Thus, when the actual compression ratio is maintained to be near the failure target value even when the driving of electric actuator 30 is stopped, microcomputer 61 can presume that internal combustion engine 1 is in a stopped state. At this time, by maintaining the stopped state (in other words, energization-shutoff state) of electric actuator 30, it is possible to prevent electric actuator 30 from consuming power in the stopped state of internal combustion engine 1 and to prevent battery 70 from being used up.

Figure 4:
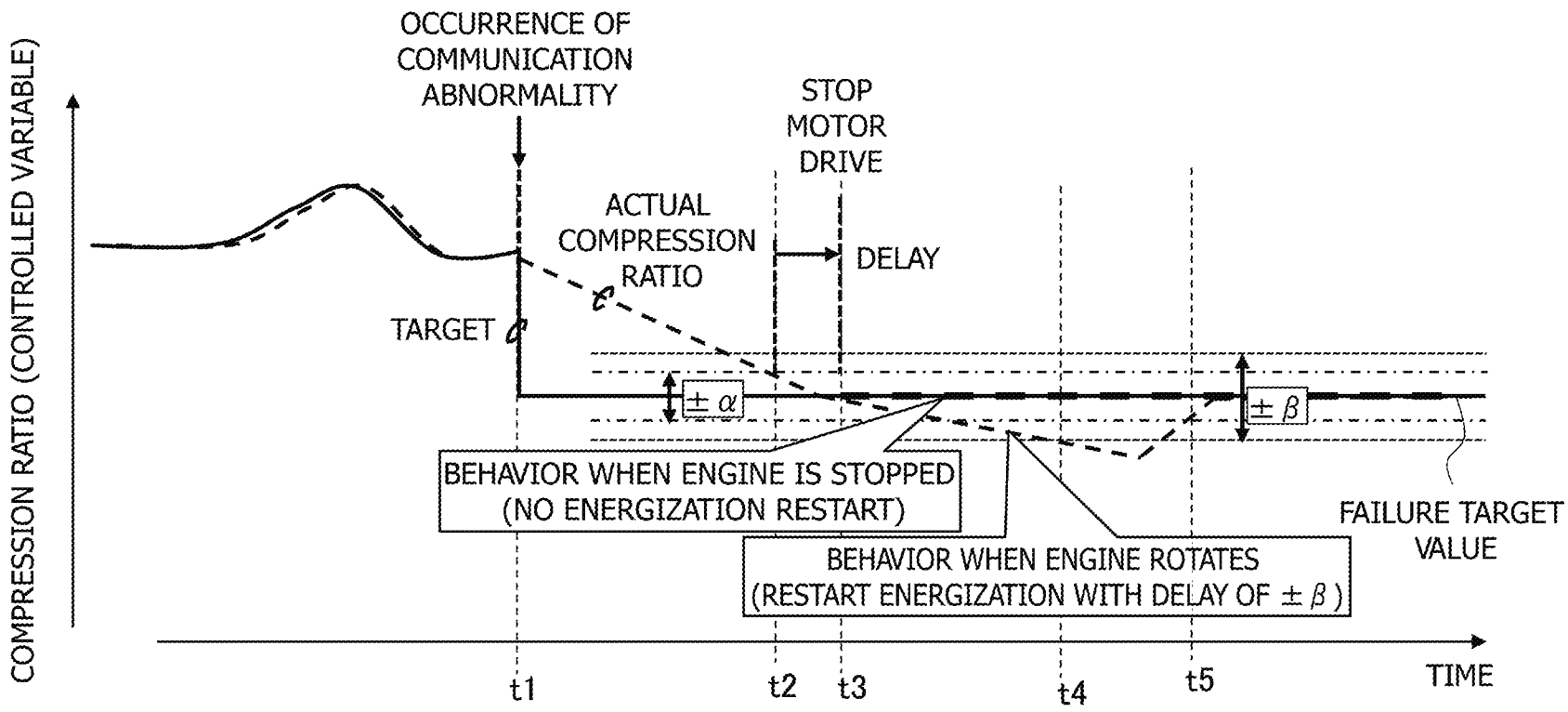
FIG. 4 is a timing chart for describing an operation of the fail-safe processing of the first example according to the embodiment of the present invention.

FIG. 4 is a timing chart for illustrating the relationship between the change in actual compression ratio in the fail-safe processing indicated in FIG. 3, and the drive control of electric actuator 30.

When a communication abnormality occurs at time t1, microcomputer 61 sets the failure target value stored in advance in the internal memory as a target value of the compression ratio, and controls electric actuator 30 in a manner such that the actual compression ratio approaches this failure target value.

Then, at time t2, the absolute value of control error becomes less than or equal to set value $\alpha$, and at a time (time t3) when a state in which the absolute value of control error is less than or equal to set value $\alpha$ continues for a predetermined time period, microcomputer 61 stops driving electric actuator 30.

After time t3 at which the driving of electric actuator 30 is stopped, if the actual compression ratio is maintained to be near the failure target value, microcomputer 61 presumes that internal combustion engine 1 is in a stopped state, and maintains electric actuator 30 in the drive stopped state.

On the other hand, after time t3 at which the driving of electric actuator 30 is stopped, if the actual compression ratio changes so as to depart from the failure target value, and the absolute value of control error becomes greater than set value $\beta$ at time t4, microcomputer 61 presumes that internal combustion engine 1 is in operation, and restarts driving (energization) of electric actuator 30 to have the actual compression ratio approaches again near the failure target value.

SECOND EXAMPLE

Figure 5:
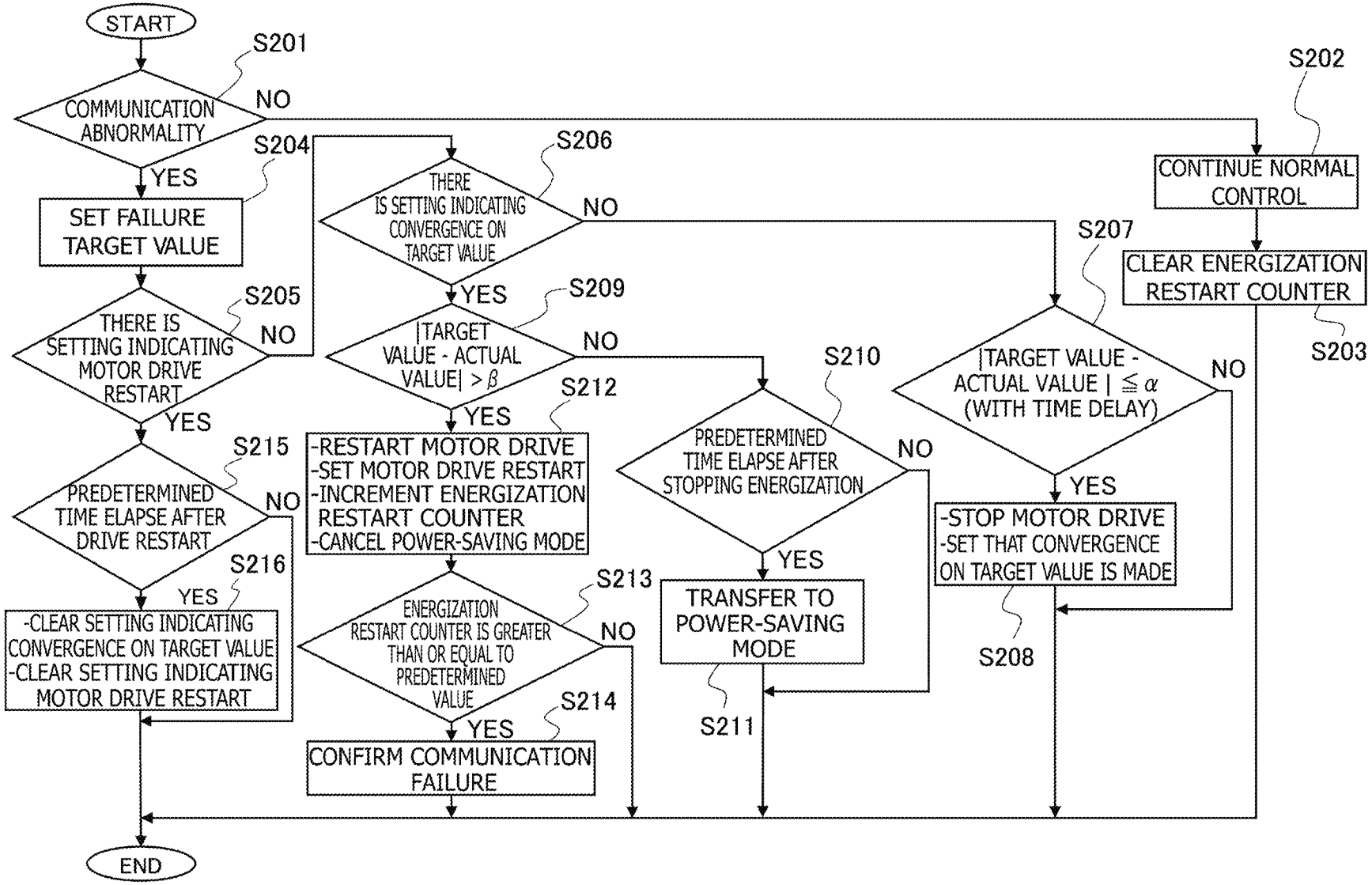
FIG. 5 is a flowchart illustrating a second example of the fail-safe processing at the time of communication abnormality according to the embodiment of the present invention.

A flowchart of FIG. 5 illustrates another aspect of the fail-safe processing at the time of communication abnormality performed by microcomputer 61 of VCR controller 31B.

The fail-safe processing illustrated in the flowchart of FIG. 5 differs from the fail-safe processing illustrated in the flowchart of FIG. 3 in processes for confirming a communication abnormality, and in that VCR controller 31B is transferred to a power-saving mode when it is presumed that internal combustion engine 1 is in a stopped state.

In step S201, microcomputer 61 determines whether an abnormality has occurred in communications with engine controller 31A through CAN 51.

Then, when there is no communication abnormality, microcomputer 61 proceeds to step S202, in which microcomputer 61 performs a normal control, that is, a control for normal communications, in which microcomputer 61 calculates a manipulated variable of electric actuator 30 based on a target value transmitted from engine controller 31A and a determination result obtained by angle sensor 29A, and outputs the calculated manipulated variable to electric actuator 30, to make an actual compression ratio approach the target value.

Then, microcomputer 61 proceeds to step S203, in which microcomputer 61 clears the count of an energization-restart counter for counting the number of times that stopping and restarting of energization are repeated during communication abnormality.

On the other hand, when a communication abnormality has occurred and data of a target value cannot be obtained from engine controller 31A, microcomputer 61 proceeds to step S204, in which microcomputer 61 sets a failure target value, which is stored in advance in the internal memory, as a target value for variable compression ratio mechanism 23.

Then, microcomputer 61 proceeds to step S205, in which microcomputer 61 determines whether electric actuator 30 is in a drive-restart state after a temporary stop of the driving of electric actuator 30.

Here, when electric actuator 30 is not in the drive-restart state, microcomputer 61 proceeds to step S206.

In step S206, microcomputer 61 determines whether there is a history indicating that the actual compression ratio converged on the failure target value by the drive control of electric actuator 30.

Then, when there is no history indicating the convergence on the failure target value, microcomputer 61 proceeds to step S207, in which microcomputer 61 determines whether an absolute value of a control error that is a difference between the failure target value and the actual compression ratio, is less than or equal to set value $\alpha$, to determine whether the actual compression ratio is in a state of converging on the failure target value.

When the actual compression ratio is not in the convergence state on the failure target value, microcomputer 61 bypasses step S208 and terminates the routine, so as to drive electric actuator 30 to control the actual compression ratio to be the failure target value.

On the other hand, when the actual compression ratio has converged on the failure target value, in other words, when the absolute value of the control error is less than or equal to set value $\alpha$ continues for a predetermined time period or more, microcomputer 61 proceeds to step S208, in which microcomputer 61 stops driving electric actuator 30 and saves the history indicating that the actual compression ratio converged on the failure target value.

Once the history indicating that the actual compression ratio converged on the failure target value is saved, microcomputer 61 determines, the next time microcomputer 61 proceeds to step S206, that there is the history indicating that the actual compression ratio converged on the failure target value, and microcomputer 61 proceeds to step S209.

In step S209, microcomputer 61 determines whether the absolute value of the difference between the failure target value and the actual compression ratio becomes greater than set value $\beta$ ($\beta>\alpha$).

Then, when the absolute value of the difference between the failure target value and the actual compression ratio is less than or equal to set value $\beta$ and when the actual compression ratio is maintained to be near the failure target value, microcomputer 61 presumes that internal combustion engine 1 is in an operation stopped state and bypasses a drive restart control of step S212, described below, to make the drive stopped state of electric actuator 30 continue.

Furthermore, when the actual compression ratio is maintained to be near the failure target value, microcomputer 61 proceeds to step S210, in which microcomputer 61 determines whether a time that has elapsed since the stopping of the driving of electric actuator 30 reaches a predetermined time period.

Then, when the time that has elapsed since the stopping of the driving of electric actuator 30 does not reach the predetermined time period, microcomputer 61 terminates the routine, whereas when the time that has elapsed since the stopping of the driving of electric actuator 30 reaches the predetermined time period, in other words, when microcomputer 61 presumes that internal combustion engine 1 in a stopped state since the elapsed time continues for the predetermined time period of more, microcomputer 61 proceeds to step S211 to have VCR controller 31B transfer to the power-saving mode.

The power-saving mode is a mode for reducing power consumption in VCR controller 31B by stopping CAN communications or by stopping supplying power to unnecessary circuits, for example, and thus, corresponds to a standby mode. That is, when internal combustion engine 1 is in a stopped state, microcomputer 61 reduces power consumption by stopping the driving of electric actuator 30, and furthermore, by reducing power consumption in VCR controller 31B, so as to reduce power consumption in the entire system as much as possible.

On the other hand, when the absolute value of the difference between the failure target value and the actual compression ratio becomes greater than set value (3, microcomputer 61 proceeds to step S212, in which microcomputer 61 restarts driving electric actuator 30 to control the actual compression ratio to be the failure target value, and saves information indicating that electric actuator 30 is in the drive-restart state.

Furthermore, in step S212, microcomputer 61 increments the count of the energization-restart counter, and cancels the power-saving mode of VCR controller 31B to make VCR controller 31B return to the normal mode.

After incrementing the count of the energization-restart counter in step S212, microcomputer 61 proceeds to step S213, in which microcomputer 61 determines whether the count of the energization-restart counter becomes greater than or equal to a set value.

Then, when the count of the energization-restart counter is less than the set value, microcomputer 61 terminates the routine, whereas when the count of the energization-restart counter becomes greater than or equal to the set value, microcomputer 61 proceeds to step S214, in which microcomputer 61 confirms the determination that the communication abnormality has occurred.

Once restarting driving electric actuator 30 due to the deviation of the actual compression ratio from the failure target value, microcomputer 61 determines, the next time microcomputer 61 proceeds to step S205, that electric actuator 30 is in the drive-restart state, and microcomputer 61 proceeds to step S215.

In step S215, microcomputer 61 determines whether a predetermined time period has elapsed since the restart of the driving of electric actuator 30, and until the driving-continuing time reaches the predetermined time period, microcomputer 61 bypasses step S216 and terminates the routine, so as to drive electric actuator 30 to continue the processing for controlling the actual control ratio to be the failure target value.

On the other hand, when the driving-continuing time reaches the predetermined time period, microcomputer 61 proceeds to step S216, in which microcomputer 61 clears the history indicating the convergence on the failure target value, and also clears a setting indicating the restart of the drive of electric actuator 30.

The processing of step S216 makes microcomputer 61 proceed from step S205 to step S206, and furthermore to step S207, the next time microcomputer 61 carries out the routine, so as to stop driving electric actuator 30 again to monitor whether the actual compression ratio changes in the drive stopped state.

That is, in a case in which an abnormality has occurred in communications with engine controller 31A through CAN 51 and internal combustion engine 1 is in operation, if the driving of electric actuator 30 is stopped after the compression ratio converges on the failure target value, the actual compression ratio changes from the failure target value, and this makes microcomputer 61 restart driving electric actuator 30, and then if a set time period has elapsed since the restart of the driving, microcomputer 61 is set to stop driving electric actuator 30 again.

Thus, if a state in which an abnormality has occurred in communications with engine controller 31A through CAN 51 and internal combustion engine 1 is in operation, continues, microcomputer 61 repeats stopping and restarting of the driving of electric actuator 30 and has the energization-restart counter count up periodically.

Here, when the count of the energization-restart counter is greater than or equal to the set value, that is, a state in which internal combustion engine 1 is in operation and communications with engine controller 31A fails, continues, microcomputer 61 proceeds to step S214, in which microcomputer 61 confirms the determination that the communication abnormality has occurred.

On the other hand, in a case in which there is an abnormality that the switching signal input to power supply control circuit 63 is fixed to a level indicating the turning on, and VCR controller 31B does not perform self-shutoff of the power supply despite power switch 71 being manipulated to be OFF, the actual compression ratio is maintained to be near the failure target value despite stopping of the driving of electric actuator 30 since internal combustion engine 1 is in a stopped state. Thus, stopping and restarting of the driving of electric actuator 30 are not repeated, and the energization-restart counter does not count up. Thus, it is possible to prevent erroneously confirming that a communication abnormality has occurred, due to the fixing abnormality of the switching signal.

THIRD EXAMPLE

Figure 6:
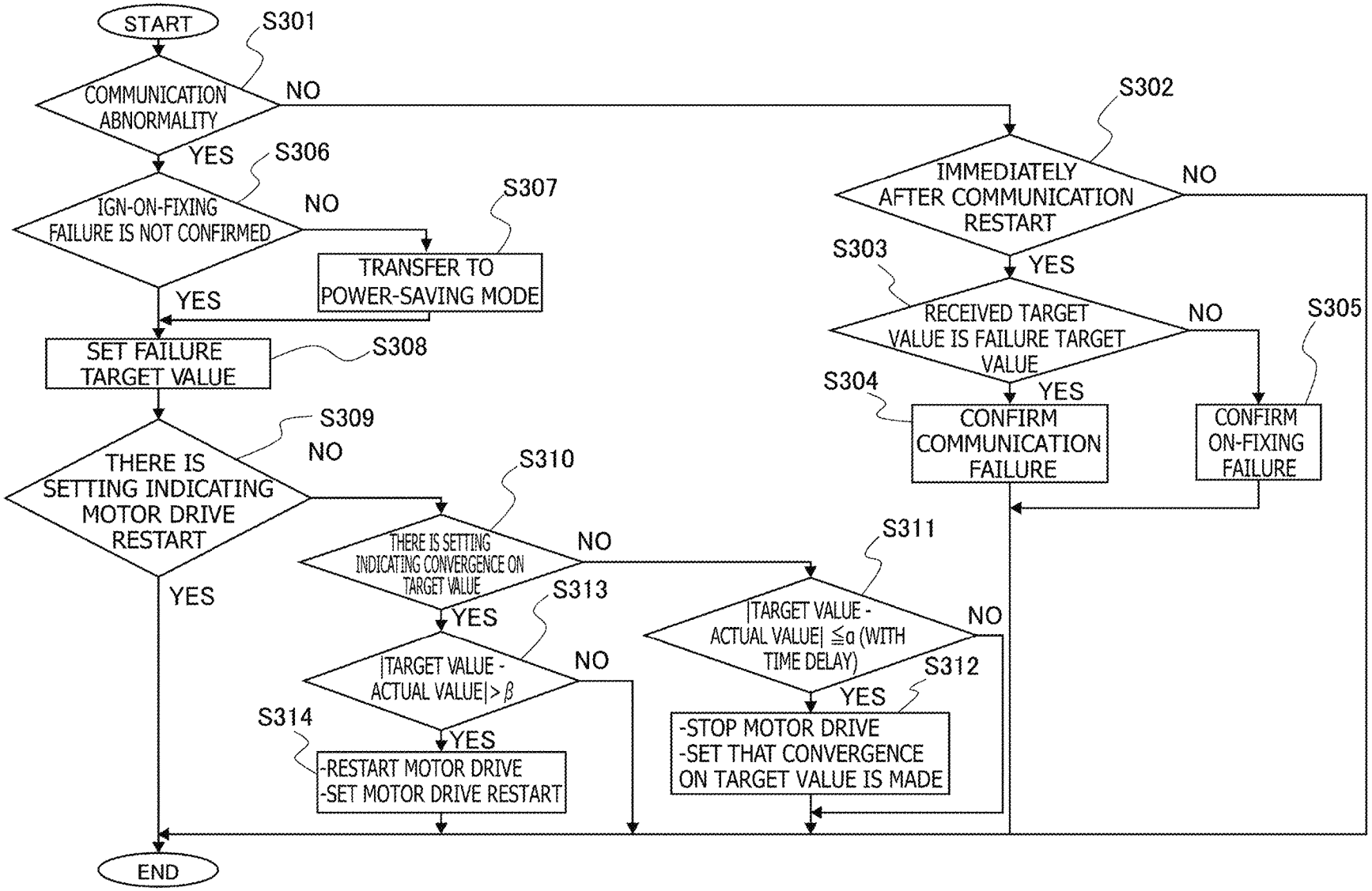
FIG. 6 is a flowchart illustrating a third example of the fail-safe processing at the time of communication abnormality according to the embodiment of the present invention.

A flowchart of FIG. 6 illustrates another aspect of the fail-safe processing at the time of communication abnormality performed by microcomputer 61 of VCR controller 31B.

The fail-safe processing illustrated in the flowchart of FIG. 6 differs from the fail-safe processing illustrated in the flowchart of FIG. 3 in that a process for confirming that there is an abnormality that the switching signal is fixed to a level indicating the turning on, and in that VCR controller 31B is transferred to a power-saving mode when the fixing abnormality of the switching signal is confirmed.

In step S301, microcomputer 61 determines whether an abnormality has occurred in communications with engine controller 31A through CAN 51.

Then, when there is no communication abnormality, microcomputer 61 proceeds to step S302, in which microcomputer 61 determines whether it is a timing immediately after a restart of communications, that is, whether it is a timing at which communications return to a normal condition from a state in which an abnormality occurs in communications with engine controller 31A.

Here, when microcomputer 61 continuously determines that communications are normal, microcomputer 61 terminates the routine.

On the other hand, when it is a timing at which communications restart, in other words, a timing at which communications return to a normal condition from a communication abnormality, microcomputer 61 proceeds to step S303, in which microcomputer 61 determines whether a target value of the compression ratio obtained from engine controller 31A at the time of the restart of communications, is the failure target value.

Then, when microcomputer 61 determines that the target value obtained from engine controller 31A is the failure target value in step S303, microcomputer 61 proceeds to step S304, in which microcomputer 61 confirms the communication abnormality determination.

On the other hand, when microcomputer 61 determines, in step S303, that the target value obtained from engine controller 31A is not the failure target value but a normal target value set in accordance with the operating conditions of internal combustion engine 1, microcomputer 61 proceeds to step S305, in which microcomputer 61 confirms the determination of the ON-fixing failure of the switching signal.

Engine controller 31A is set to continue performing processing for transmitting a failure target value stored in advance in an internal memory to VCR controller 31B as a target value of the compression ratio, when an abnormality occurs in communications with VCR controller 31B, and furthermore, engine controller 31A is set to confirm a diagnosis result of communication abnormality with delay when engine controller 31A receives the diagnosis result from VCR controller 31B.

The failure target value stored in advance in the internal memory of engine controller 31A is the same as the failure target value stored in the internal memory of VCR controller 31B.

Thus, in a case in which there is an abnormality that the switching signal input to power supply control circuit 63 of VCR controller 31B is fixed to a level indicating the turning on, and the shutting off of the power supply to engine controller 31A caused by the turning off of power switch 71 makes VCR controller 31B detect a communication abnormality in communications with engine controller 31A, if power switch 71 is manipulated to be ON and engine controller 31A is started up thereby, engine controller 31A transmits a normal compression ratio target value to VCR controller 31B.

On the other hand, in a case in which a communication abnormality has occurred when both engine controller 31A and VCR controller 31B are in operation, since engine controller 31A continues the processing for transmitting the failure target value to VCR controller 31B, VCR controller 31B is to receive the failure target value from engine controller 31A at restart of communications.

Thus, by determining whether the target value of the compression ratio obtained from engine controller 31A at the restart of communications is the failure target value or a normal target value set in accordance with the engine operating conditions, microcomputer 61 can distinguish whether communications fail due to stop of the operation of engine controller 31A in a state in which the switching signal in VCR controller 31B is fixed to a level indicating the turning on despite CAN 51 and communication circuits, and the like, being normal, or an abnormality has occurred in the communication system, such as CAN 51 and communication circuits.

Microcomputer 61 is configured that, when confirming the communication failure, or when confirming the ON-fixing failure of the switching signal, microcomputer 61 saves each diagnosis result in the internal memory. Furthermore, microcomputer 61 is configured such that a diagnosis history can be read out by connecting a checking tool to, for example, CAN 51 in a maintenance factory, or the like.

Thus, a mechanic can recognize an occurrence of a communication failure in VCR controller 31B or an ON-fixing failure of the switching signal. Thus, it is possible to isolate a cause of the communication abnormality, resulting in efficient maintenance.

On the other hand, when a communication abnormality has occurred and the data of a target value cannot be obtained from engine controller 31A, microcomputer 61 proceeds from step S301 to step S306, in which microcomputer 61 determines whether the determination of the ON-fixing failure of the switching signal is confirmed.

In a case in which it is diagnosed that the communication abnormality has occurred and the determination of the ON-fixing failure of the switching signal is confirmed, microcomputer 61 can presume that the power supply to engine controller 31A is shut off due to the turning off of power switch 71 and internal combustion engine 1 is in a stopped state.

Thus, when the determination of the ON-fixing failure of the switching signal is confirmed, microcomputer 61 proceeds to step S307, in which microcomputer 61 causes VCR controller 31B to transfer to the power-saving mode in which the transmission operation to engine controller 31A or the like is stopped while the reception operation from engine controller 31A or the like is continued.

After transfer to the power-saving mode in step S307, microcomputer 61 proceeds to step S308. When determining, in step S306, that the ON-fixing failure of the switching signal is not confirmed, microcomputer 61 proceeds to step S308.

In step S308, microcomputer 61 sets the failure target value stored in advance in the internal memory as a target value for the variable compression ratio mechanism 23.

Then, microcomputer 61 proceeds to step S309, in which microcomputer 61 determines whether electric actuator 30 is in a drive-restart state for controlling the compression ratio to be the failure target value after a temporary stop of the driving of electric actuator 30.

Here, when electric actuator 30 is not in the drive-restart state, microcomputer 61 proceeds to step S310.

In step S310, microcomputer 61 determines whether there is a history indicating that the actual compression ratio converged on the failure target value by the drive control of electric actuator 30.

Then, when there is no history indicating the convergence on the failure target value, microcomputer 61 proceeds to step S311, in which microcomputer 61 determines whether an absolute value of a control error that is a difference between the failure target value and the actual compression ratio, is less than or equal to set value $\alpha$, to determine whether the actual compression ratio is in a state of converging on the failure target value.

When the actual compression ratio is not in the convergence state on the failure target value, microcomputer 61 bypasses step S312 and terminates the routine, so as to drive electric actuator 30 to control the actual compression ratio to be the failure target value.

On the other hand, when the actual compression ratio has converged on the failure target value, microcomputer 61 proceeds to step S312, in which microcomputer 61 stops driving electric actuator 30 and saves the history indicating that the actual compression ratio converged on the failure target value.

Once the history indicating that the actual compression ratio converged on the failure target value is saved, microcomputer 61 determines, the next time microcomputer 61 proceeds to step S310, that there is the history indicating that the actual compression ratio converged on the failure target value, and microcomputer 61 proceeds to step S313.

In step S313, microcomputer 61 determines whether the absolute value of the difference between the failure target value and the actual compression ratio becomes greater than set value $\beta$ ($\beta>\alpha$).

Then, when the absolute value of the difference between the failure target value and the actual compression ratio is less than or equal to set value $\beta$ and when the actual compression ratio is maintained to be near the failure target value, microcomputer 61 presumes that internal combustion engine 1 is in a stopped state and bypasses step S314, so as to make the drive stopped state of electric actuator 30 continue.

On the other hand, when the absolute value of the difference between the failure target value and the actual compression ratio becomes greater than set value (3, microcomputer 61 presumes that internal combustion engine 1 is in an operation state and proceeds to step S314, in which microcomputer 61 restarts driving electric actuator 30 to control the actual compression ratio to be the failure target value, and saves information indicating that electric actuator 30 is in the drive-restart state.

Figure 7:
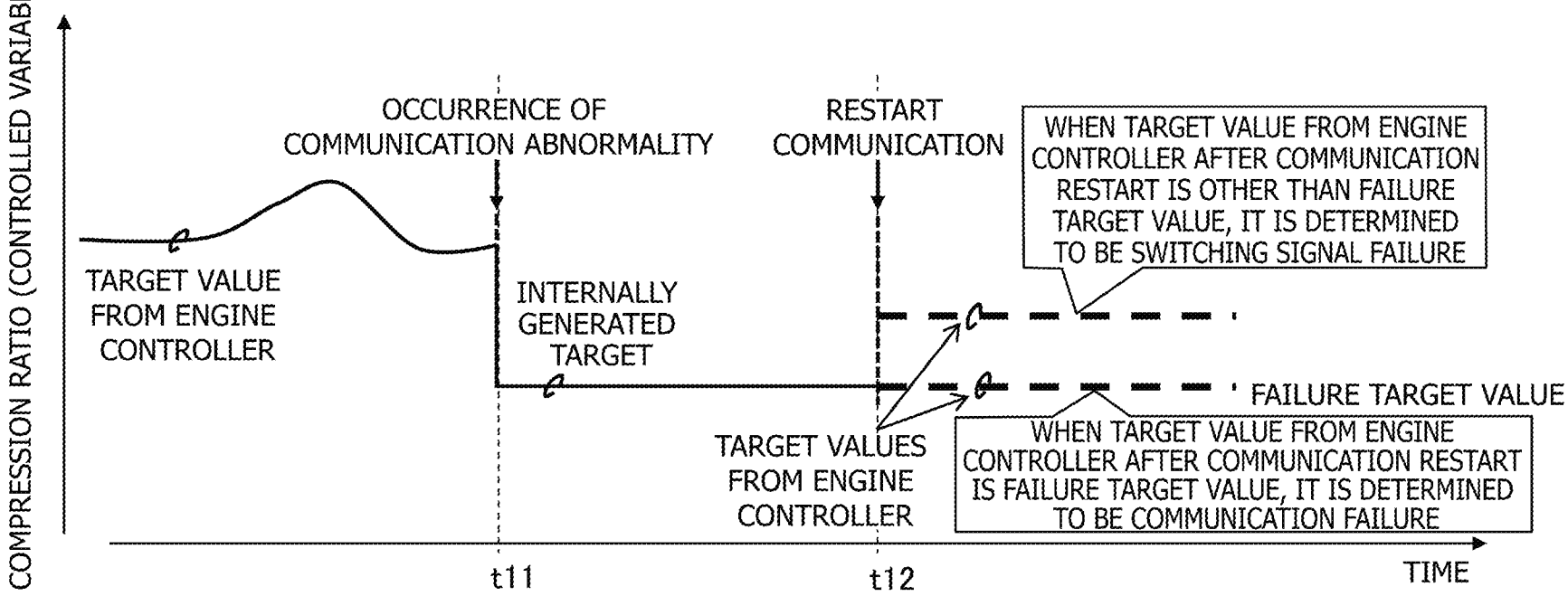
FIG. 7 is a timing chart for describing an operation of the fail-safe processing of the third example according to the embodiment of the present invention.

FIG. 7 is a timing chart for describing processes of steps S302-S305 in the abovementioned flowchart of FIG. 6.

In FIG. 7, when a communication abnormality occurs at time t11, microcomputer 61 switches the target value of the compression ratio from the target value obtained from engine controller 31A to the failure target value stored in advance in the internal memory.

Then, at time t12, communications between engine controller 31A and VCR controller 31B restart, and microcomputer 61 of VCR controller 31B obtains a target value output from engine controller 31A.

Here, when the target value obtained from engine controller 31A at the time of restart of communications differs from the failure target value, in other words, when the target value obtained from engine controller 31A at the time of restart of communications is a normal target value, microcomputer 61 determines that there is a communication abnormality due to the ON-fixing failure of the switching signal and engine controller 31A, which starts up in accordance with the turning on of power switch 71, outputs the normal target value.

On the other hand, when the target value obtained from engine controller 31A at the time of restart of communications is the failure target value which is the same as the failure target value generated internally, the microcomputer 61 determines that since an abnormality in communication system such as CAN 51 or communication circuits occurs, engine controller 31A also determines the occurrence of the communication abnormality and outputs the failure target value to VCR controller 31B as the target value of the compression ratio.

FOURTH EXAMPLE

Figure 8:
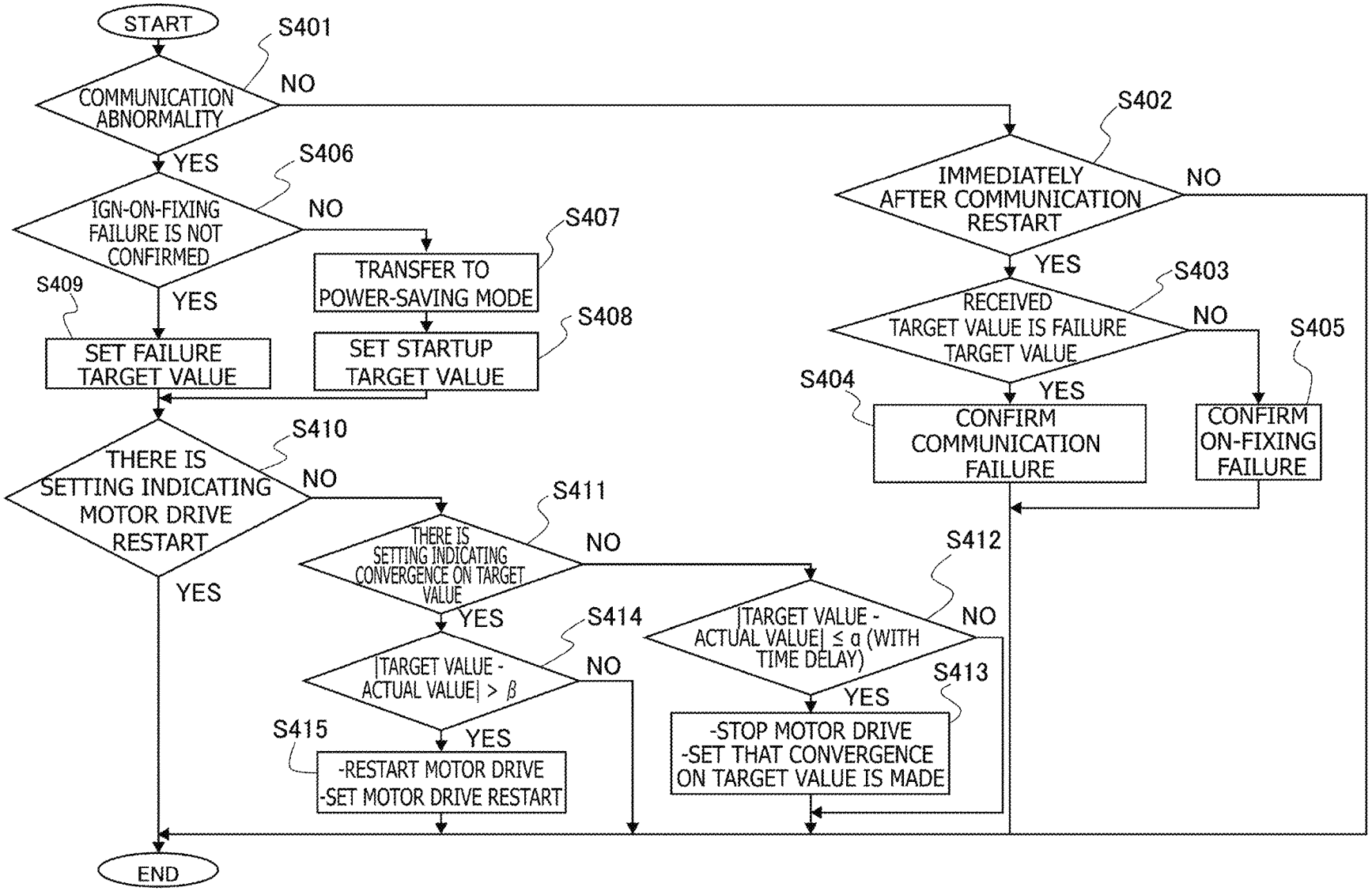
FIG. 8 is a flowchart illustrating a fourth example of the fail-safe processing at the time of communication abnormality according to the embodiment of the present invention.

A flowchart of FIG. 8 illustrates another aspect of the fail-safe processing at the time of communication abnormality performed by microcomputer 61 of VCR controller 31B.

The fail-safe processing illustrated in the flowchart of FIG. 8 differs from the fail-safe processing illustrated in the flowchart of FIG. 6 in that microcomputer 61 sets a startup target value of internal combustion engine 1 as the target value of the compression ratio at the time of communication abnormality at which an abnormality that the switching signal is fixed to a level indicating the turning on is confirmed.

In step S401, microcomputer 61 determines whether an abnormality has occurred in communications with engine controller 31A through CAN 51.

Then, when there is no communication abnormality, microcomputer 61 proceeds to step S402, in which microcomputer 61 determines whether it is a timing immediately after a restart of communications, that is, whether it is a timing at which communications return to a normal condition from a state in which an abnormality occurs in communications with engine controller 31A.

Here, when microcomputer 61 continuously determines that communications are normal, microcomputer 61 terminates the routine.

On the other hand, when it is a timing at which communications restart, in other words, a timing at which communications return to a normal condition from a communication abnormality, microcomputer 61 proceeds to step S403, in which microcomputer 61 determines whether a target value of the compression ratio obtained from engine controller 31A at the time of the restart of communications, is the failure target value.

Then, when microcomputer 61 determines that the target value obtained from engine controller 31A is the failure target value in step S403, microcomputer 61 proceeds to step S404, in which microcomputer 61 confirms the communication abnormality determination.

On the other hand, when microcomputer 61 determines, in step S403, that the target value obtained from engine controller 31A is not the failure target value but a normal target value set in accordance with the operating conditions of internal combustion engine 1, microcomputer 61 proceeds to step S405, in which microcomputer 61 confirms the determination of the ON-fixing failure of the switching signal.

Furthermore, when a communication abnormality has occurred and data of a target value cannot be obtained from engine controller 31A, microcomputer 61 proceeds from step S401 to step S406, in which microcomputer 61 determines whether the determination of the ON-fixing failure of the switching signal is confirmed.

When the determination of the ON-fixing failure of the switching signal is confirmed, microcomputer 61 proceeds to step S407, in which microcomputer 61 causes VCR controller 31B to transfer to the power-saving mode in which the transmission operation to engine controller 31A or the like is stopped while the reception operation from engine controller 31A or the like is continued.

Then, microcomputer 61 proceeds to step S408, in which microcomputer 61 sets the startup target value that is a compression ratio suitable for startup of internal combustion engine 1, as a target value which is generated internally in a state in which a target value cannot be obtained from engine controller 31A due to the communication abnormality.

On the other hand, when microcomputer 61 determines, in step S406, that the determination of the ON-fixing failure of the switching signal is not confirmed, microcomputer 61 proceeds to step S409, in which microcomputer 61 sets the failure target value (failure target value startup target value), as a target value which is generated internally in a state in which a target value cannot be obtained from engine controller 31A due to the communication abnormality.

The startup target value and the failure target value are a value stored in advance in the internal memory of microcomputer 61 and are an intermediate value within a variable range of compression ratio.

Then, microcomputer 61 proceeds to step S410, in which microcomputer 61 determines whether electric actuator 30 is in a drive-restart state for controlling the compression ratio to be the target value of compression ratio (startup target value or failure target value) after a temporary stop of electric actuator 30.

Here, when electric actuator 30 is not in the drive-restart state, microcomputer 61 proceeds to step S411, in which microcomputer 61 determines whether there is a history indicating that the actual compression ratio converged on the target value by the drive control of electric actuator 30.

Then, when there is no history indicating the convergence on the target value, microcomputer 61 proceeds to step S412, in which microcomputer 61 determines whether an absolute value of a control error that is a difference between the target value and the actual compression ratio, is less than or equal to set value $\alpha$, to determine whether the actual compression ratio is in a state of converging on the target value.

When the actual compression ratio is not in the convergence state on the target value, microcomputer 61 bypasses step S413 and terminates the routine, so as to drive electric actuator 30 to control the actual compression ratio to be the target value.

On the other hand, when the actual compression ratio has converged on the target value, microcomputer 61 proceeds to step S413, in which microcomputer 61 stops driving electric actuator 30 and saves the history indicating that the actual compression ratio converged on the target value.

Once the history indicating that the actual compression ratio converged on the target value is saved, microcomputer 61 determines, the next time microcomputer 61 proceeds to step S411, that there is the history indicating that the actual compression ratio converged on the target value, and microcomputer 61 proceeds to step S414.

In step S414, microcomputer 61 determines whether the absolute value of the difference between the target value and the actual compression ratio becomes greater than set value $\beta$ ($\beta>\alpha$).

Then, when the absolute value of the difference between the target value and the actual compression ratio is less than or equal to set value $\beta$ and when the actual compression ratio is maintained to be near the target value, microcomputer 61 presumes that internal combustion engine 1 is in a stopped state, and then, bypasses step S415 and terminates the routine, so as to make the drive stopped state of electric actuator 30 continue.

On the other hand, when the absolute value of the difference between the target value and the actual compression ratio becomes greater than set value (3, microcomputer 61 proceeds to step S415, in which microcomputer 61 restarts driving electric actuator 30 to control the actual compression ratio to be the target value, and saves information indicating that electric actuator 30 is in the drive-restart state.

In the foregoing fail-safe processing, when the ON-fixing failure of the switching signal in VCR controller 31B has occurred and the communication abnormality has occurred, in other words, when the power supply to engine controller 31A is shut off due to the turning off of power switch 71 and internal combustion engine 1 is in a stopped state, VCR controller 31B can control in advance the compression ratio which is made variable by variable compression ratio mechanism 23 to be a compression ratio suitable for startup of internal combustion engine 1 for the restart of internal combustion engine 1 based on the turning on of power switch 71, and thus, it is possible to prevent a decrease in startup performance of internal combustion engine 1 that may be caused by the ON-fixing failure of the switching signal.

The contents of the invention have been described in detail above with reference to the preferred embodiments, but it is apparent that one skilled in the art can make various types of modifications based on the basic technical concept and teachings of the invention.

The variable mechanism for an internal combustion engine that makes the operating characteristics of a vehicle internal combustion engine variable by an electric actuator and that receives the reaction force that changes the operating characteristics by the operation of the internal combustion engine, is not limited to variable compression ratio mechanism 23.

For example, an electric-drive variable valve timing mechanism that makes the phase of an opening period of an engine valve, as disclosed in JP 2009-174473 A, for example, or an electric-drive variable valve mechanism that makes a maximum valve lift amount and an operation angle of an engine valve, as disclosed in JP 2012-036864 A, for example, may be controlled by the variable mechanism.

Here, in a case of an electric-drive variable valve mechanism, the operating characteristics of the internal combustion engine, which is made variable by the mechanism, is a phase of an opening period of the engine valve. In a case of a variable valve mechanism, the operating characteristics of the internal combustion engine, which is made variable by the mechanism, is a maximum valve lift amount and an operation angle.

Furthermore, the drive-stopping processing of electric actuator 30 in step S107 of FIG. 3, and the like, may include a process for supplying, to electric actuator 30, power that is within a range which does not cause a substantive change in controlled variable, in addition to the process for shutting off energization.

Furthermore, the fail-safe processing of the control device that controls the variable mechanism is not limited to the process for making the operating characteristics of the internal combustion engine converge on the target value by the variable mechanism, followed by stopping driving of the electric actuator. The control device may stop driving the electric actuator if the operating characteristics of the internal combustion engine are within a predetermined range when a communication abnormality occurs, and then monitor a change in the operating characteristics, so as to presume whether the internal combustion engine is in operation.

Furthermore, a trigger to perform a process in which driving of the electric actuator is stopped when the operating characteristics of the internal combustion engine is an intermediate value and it is determined whether the internal combustion engine is in operation based on a change in the operating characteristics after stopping, is not limited to an abnormality in communications with an external device. For example, the trigger may be a reception of a signal that indicates an occurrence of an abnormality in the external device.

Furthermore, the control device for controlling the variable mechanism may switch target values of the operating characteristics based on a determination result of whether the internal combustion engine is in operation based on a change in the operating characteristics.

Furthermore, when presuming that the internal combustion engine is in a stopped state, the control device for controlling the variable mechanism may stop driving electric actuator 30 and transfer to a power-saving mode.

Furthermore, the control device for controlling the variable mechanism may transmit a signal that indicates a presumption result of whether the internal combustion engine is in a stopped state or in operation, to another device through an in-car communication line, such as CAN.

REFERENCE SYMBOL LIST

1 Internal combustion engine
23 Variable compression ratio mechanism
30 Electric actuator
31A Engine controller
31B VCR controller
51 CAN
61 Microcomputer
62 Power supply IC
63 Power supply control circuit
71 Power switch

The invention claimed is:

1. A control device for an internal combustion engine for a vehicle, that controls a variable mechanism that makes operating characteristics of the internal combustion engine variable by changing a position of an electric actuator within a range defined by a restriction provided by stoppers, the variable mechanism receiving a reaction force that changes the position of the electric actuator by operation of the internal combustion engine, the control device comprising a control unit that:

when the position of the electric actuator does not change from a position apart from the stoppers and driving of the electric actuator is stopped, maintains the driving of the electric actuator to be in the stopped state, and when the position of the electric actuator changes from the position apart from the stoppers and driving of the electric actuator is stopped, restarts the driving of the electric actuator, wherein the control device receives a target value for the variable mechanism from an external device through an in-car communication line, the control unit operates when an abnormality occurs in communications through the in-car communication line, and the control unit confirms that there is an abnormality in communications through the in-car communication line, when the restart of the driving of the electric actuator repeats a predetermined number of times.

2. The control device for the internal combustion engine, according to claim 1, wherein the control unit controls the position of the electric actuator to be a predetermined position apart from the stoppers and then stops the driving of the electric actuator, and the control unit restarts the driving of the electric actuator when the position of the electric actuator changes from the predetermined position after stopping the driving of the electric actuator, to control the position of the electric actuator to be the predetermined position.

3. The control device for the internal combustion engine, according to claim 1, wherein the control unit stops the driving of the electric actuator again when a predetermined time period has elapsed since the restart of the driving of the electric actuator.

4. The control device for the internal combustion engine, according to claim 1, wherein the control unit controls the variable mechanism to be a target value for abnormal state stored in an internal memory when restarting the driving of the electric actuator.

5. The control device for the internal combustion engine, according to claim 1, wherein the control unit switches a mode of the control device to a power-saving mode, when the stopped state of the driving of the electric actuator continues for a predetermined time period.

6. The control device for the internal combustion engine, according to claim 1, further comprising a power supply unit that switches between power application to the control device and power shutoff based on a switching signal indicating a manipulated state of a power switch of the internal combustion engine, wherein the control unit confirms that there is an abnormality in the switching signal, when the target value for the variable mechanism transmitted from the external device at the time of the restart of communications through the in-car communication line is a target value for normal communication.

7. The control device for the internal combustion engine, according to claim 6, wherein the control unit switches a mode of the control device to a power-saving mode when it is confirmed that there is an abnormality in the switching signal and the communications through the in-car communication line is abnormal.

8. The control device for the internal combustion engine, according to claim 6, wherein the control unit controls the variable mechanism to be a target value for startup of the internal combustion engine by driving the electric actuator, when it is confirmed that there is an abnormality in the switching signal and the communications through the in-car communication line is abnormal.

9. The control device for the internal combustion engine, according to claim 1, wherein the variable mechanism is a variable compression ratio mechanism that makes a mechanical compression ratio variable by changing a top dead center position of a piston of the internal combustion engine by the electric actuator.

* * * * *